United States Patent [19]

Buckley et al.

[11] Patent Number: 4,690,284

[45] Date of Patent: Sep. 1, 1987

[54] METHOD OF AND APPARATUS FOR INSPECTING OBJECTS USING MULTIPLE POSITION DETECTORS

[75] Inventors: B. Shawn Buckley; Roy H. Reichwein; Edward M. Buckley, all of San Jose; James A. Pinyan, Sunnyvale, all of Calif.

[73] Assignee: Cochlea Corporation, San Jose, Calif.

[21] Appl. No.: 784,009

[22] Filed: Oct. 4, 1985

[51] Int. Cl.[4] ..... B07C 5/344

[52] U.S. Cl. ..... 209/590; 209/576; 367/11; 367/96

[58] Field of Search ..... 209/555, 556, 558, 563-566, 209/570-572, 576, 590; 367/7, 8, 11, 87, 96; 358/101, 106, 107

[56] References Cited

U.S. PATENT DOCUMENTS

| | | | |
|---|---|---|---|
| 3,289,832 | 12/1966 | Ramsay | 209/566 |
| 3,324,302 | 6/1967 | Orr et al. | 209/653 X |
| 3,386,575 | 6/1968 | Quinn | 209/564 X |
| 3,736,552 | 5/1973 | Sessler et al. | 367/7 |
| 3,803,606 | 4/1974 | Lebail et al. | 367/8 X |
| 3,804,270 | 4/1974 | Michaud et al. | 209/564 X |
| 4,433,385 | 2/1984 | DeGasperi et al. | 358/106 X |

*Primary Examiner*—Randolph A. Reese
*Assistant Examiner*—Edward M. Wacyra
*Attorney, Agent, or Firm*—Robert Shaw

[57] ABSTRACT

Apparatus (and method) for parts sorting and the like wherein parts and the like are transported into an interaction region and irradiated with wave energy which interacts with the parts and the like to provide wave energy that emits from the interaction region. The positions of the parts and the like as they move through the interaction region are detected at spaced locations along the path of travel therethrough. The wave energy that emits from the interaction region is sensed to derive a characteristic of the parts and the like at each of the spaced locations to provide signals from which the characteristic can be determined. The signals are analyzed for each spaced location to derive data representative of the characteristic which serves as the basis for sorting.

17 Claims, 9 Drawing Figures

FREQUENCY
OF USE
σ1
181

Δ̄Ø1 - ΔØ|BAD
Δ̄Ø1
ΔØ

σi
182

Δ̄Øi - ΔØi|BAD
Δ̄Øi
ΔØ

σN
183

Δ̄Ø64 - ΔØ64|BAD
Δ̄Ø64
ΔØ

191

U
B
Δ̄Ø1-ΔØ1|UNK
Δ̄Ø1-ΔØ1|BAD
Δ̄Ø1
ΔØ1

192

B
U
Δ̄Øi-ΔØi|BAD
Δ̄Øi-ΔØi|UNK
Δ̄Øi
ΔØi

193

U
B
Δ̄Ø64-ΔØ64|UNK
Δ̄Ø64-ΔØ64|BAD
Δ̄Ø64
ΔØ64

METHOD OF AND APPARATUS FOR INSPECTING OBJECTS USING MULTIPLE POSITION DETECTORS

The present invention relates to automatic sensing and positioning of objects in automated manufacturing.

Manufactured parts often have flaws as a result of the manufacturing process: parts become mixed, dies break, taps break, and stampings have mishits, among other flaws of manufactured articles. To ensure quality of the assembly of these components, the parts must be tested and inspected prior to assembly.

In manual assembly the inspection task is relatively easy, particularly with respect to gross defects. A manual assembler notices defects in parts and does not use them to produce a final assembly. With automated equipment such as transfer lines, indexing machines and robots, defective components can jam or break equipment, increasing production costs as the assembly line stops. Moreover, defective sub-assemblies can be produced even if the equipment does not jam—only to create jams further downstream in the production process, or ultimately, to produce defective products.

A method is needed to permit quick and accurate detection of flaws in parts. Optical inspection equipment—using lasers and video equipment—has been effective in detecting such errors. However, the equipment is expensive and must be programmed to detect the minute differences often required to identify defects. Another technique is the use of acoustic and low frequency (e.g., less than 300 kHz) electromagnetic inspection. Here, sound and low frequency electromagnetic waves rather than light waves (i.e., frequencies in and around the optical spectrum) are used to identify correct parts or other objects. Certain defects are more readily detected using these techniques which are inherently three-dimensional. In addition, the acoustic and electromagnetic techniques use cheaper sensors, require less computing power to identify a defect, and are easier to program.

Methods whereby acoustic and/or electromagnetic waves are used to determine the shape and/or position of objects are described in U.S. Pat. Nos. 4,095,475; 4,200,291; 4,287,769; and in pending applications Ser. No. 508,121 (now U.S. Pat. No. 4,576,285); Ser. No. 508,122 (now U.S. Pat. No. 4,557,386); and Ser. No. 508,123 (all filed on June 27, 1983 and assigned to the assignee of the present invention).

In the systems disclosed in the above-mentioned patents and patent applications, waves are directed onto an object by wave sources to set up an acoustic field or an electromagnetic field. Distortions in the field are detected by an array of acoustic or electromagnetic receivers, respectively. The received signals are processed, for example, by digital filters which determine the phase and/or the amplitude of the waves received. A computer compares the phase and/or amplitude information with similar information for acceptable objects. In one embodiment, a pattern recognition algorithm reduces the information from the multiplicity of receivers to a single number which indicates how similar an object is to a standard object.

The present invention is applicable to both acoustic and low frequency electromagnetic waves as the objects under inspection are moved past a transducer array. By using a multiplicity of detectors which locate the position of the object at various points relative to the transducers, data from different perspectives can be recorded. Furthermore, this data is weighted in several ways to sensitize the transducer measurements for particular applications. In one weighting method, measurement changes in the particular transducer being monitored are weighted according to the statistical scatter of the measurements themselves. In another, they are weighted according to which measurements best detect defects in the particular objects being inspected.

Accordingly, it is an objective of the present invention to provide a method (and apparatus) for sorting parts and the like of particular use in connection with automated equipment.

Another objective is to provide a system which discriminates between parts which give faulty readings because of unacceptable geometric deviations and those for which such faulty readings occur because of position or orientation deviations from a standard part.

Still another objective is to provide a system for sorting such parts and the like, one that discriminates selectively between acceptable parts and unacceptable parts.

These and still further objectives are addressed hereinafter.

The foregoing objectives are attained, generally, in a method of (and apparatus for) determining a characteristic of an object, that includes: transporting the object into and through an interaction region; transmitting continuous wave energy of a narrow band of frequencies (or single frequency) into the interaction region where the wave energy interacts with the object, is affected by the interaction with the object and, after the interaction, emits from the interaction region; detecting at spaced locations within the interaction region the positions of the object as it moves into and through the interaction region to provide a feedback signal indicating the particular location of the object within the interaction region as it passes therethrough; sensing the wave energy that emits from the interaction region at a multiplicity of spaced places to provide electric signals representative of the characteristic for each location; processing the electric signals for each location to derive therefrom information regarding each place of the multiplicity of spaced places and for each location of the spaced locations; analyzing the information for each place of the multiplicity of places with respect to each particular location to derive data representing the characteristic of the object at each said location; and sorting the object on the basis of the data.

The invention is hereinafter described with reference to the accompanying drawing in which.

There now follows a discussion of the technique by which the present invention interprets wave information from various transducers. More detail on wave interpretation in general can be found in the above-mentioned U.S. Pat. Nos. 4,095,475 and 4,200,291 and the above-mentioned U.S. patent application Ser. No. 508,121 (now U.S. Pat. No. 4,576,286) the disclosures of which are incorporated herein by reference. The particular system shown here is one for inspecting parts (or other objects) according to their orientation, shape, or electromagnetic characteristics, which system uses acoustic or electromagnetic sensors.

Figure 1:
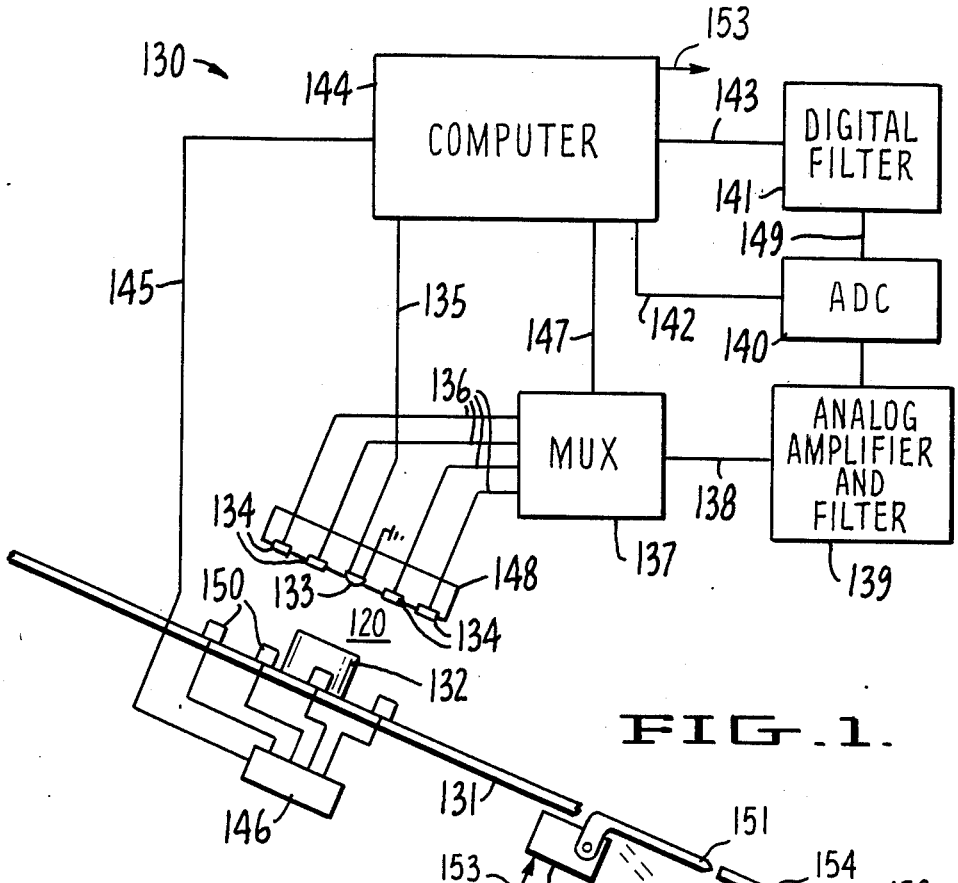
FIG. 1 is a diagrammatic representation of a sorting system embodying the present inventive concepts.

In the drawing, FIG. 1 shows a sorting system 130 which inspects parts according to the present teachings. An object such as the part labeled 132 in FIG. 1 is fed down a transport mechanism such as the chute marked 131. Parts similar to the part 132 are fed to the top of the chute 131, for example, by a parts feeder of the type shown in commonly assigned U.S. patent application Ser. No. 508,121 (and not shown here to simplify the present disclosure). In this example, a sensing array 148 has a transmitting transducer 133 driven by a sinusoidal continuous wave signal from a computer 144. The part 132 is delivered by a feeder (see U.S. patent application Ser. No. 508,121) and is transported by gravity down the chute or slide 131 into and, eventually, through an interaction region 120. The transducer 133 transmits continuous wave energy (acoustic, e.g., about 20 kHz to about 200 kHz, or low frequency electromagnetic wave energy, e.g., about 100 kHz to 200 kHz) of a narrow band of frequencies (i.e., single frequency) into the interaction region 120 where the wave energy interacts with the part 132, is affected in phase and/or amplitude by interaction with the part 132 and, after the interaction, emits from the interaction region 120 to propagate to a sensing region where it is sensed, as noted below.

As the part 132 slides down the chute 131 its location (or position) within the interaction region 120 is detected at spaced locations, as later discussed, by position sensors 150 as it moves into and through the interaction region 120 to provide a feedback signal on a conductor 145 to the computer 144; the position sensors 150 are distributed along the path of travel through the interaction region 120. The feedback signal indicates the particular location of the part within the interaction region 120 as the part moves therethrough. Wave energy, after interaction with the part 132, as later discussed, emits from the interaction region to be sensed, in a sensing region, by a plurality of spaced sensors 134, as later discussed, at a multiplicity of spaced places to provide electric signals representative of the characteristic (e.g., shape) for each location of the part within the interaction region 120. In FIG. 1 there are four detectors 150; hence four position stations are provided at which the part 132 provides reflected wave energy that can be analyzed in the manner discussed below to give data representing shape or some other characteristic of the part 132 at each of the four positions. Processing of the received wave energy, then, is done for each sensor 134 and for each of the four spaced locations along the chute 131 in the sensing region, as now discussed in greater detail.

The wave energy from the transmitting sensor, as above indicated, interacts with the part 132 changing the phase and amplitude of the continuous wave signals detected by the receiving sensors 134. These signals are fed to a multiplexor (MUX) via connections 136; one of the signals is chosen by the computer 144 to be analyzed. The connection 147 is a bus by which the computer 144 signals the multiplexor (MUX) 137 which of the signals on connections 136 is chosen. The chosen sinusoidal signal from the sensors 134 is fed via connection 138 to an analog amplifier and filter 139 which amplifies or attenuates the signal (as required) and reduces noise at frequencies other than the sinusoidal operating frequency of the transmitting wave energy.

Next, the signal is converted to a digital value in the analog to digital converter (ADC) 140. The filtered sinusoidal signal is sampled at various time intervals as determined by a clock signal fed to the ADC 140 by the computer 144 by a connection 142. The sampled values are sent to a digital filter 141 via bus 149 where they are further filtered to remove noise at frequencies other than the transmitted wave energy frequency. Lastly, the filtered data is transmitted to the computer 144 via bus 143 for analysis. Analysis of the filtered data first requires that the data be converted to amplitude and phase information of the received wave energy for the chosen sensor 134. A Fourier transform algorithm readily converts the digital values to amplitude and phase information.

The operation of the MUX 137 to begin the multiplexing of signals 136 from sensors is initialized by the object 132 triggering the first position detector 150. On triggering of the first detector 150, a feedback signal is transmitted via a multiplexor (MUX) 146 through the bus 145 to the computer 144. The computer initiates the signal on connection 147 to begin data taking from each succesive sensor 134. On completion, the MUX 146 transmits the signal from the next position detector 150 to the computer 144 to begin data taking again from the sensors 134 when the object 132 arrives. This process of data taking on triggering from the detectors 150 continues until the object no longer triggers the detectors 150.

The computer 144, then, orchestrates data gathering from the sensors 134. First it transmits the continuous wave energy voltage signal at the proper frequency to the transmitter 133. Then it directs, one after another, the received sensor signals output from the MUX 137 to the filter 139 on detections of the object 132 by the detectors 150. The computer 144 also determines the timing and the duration of the data sampling in the ADC 140 and, further, receives and analyzes the amplitude and phase information from the digital filter 141. Each sensor signal in turn is so processed. The computer 144 also stores the amplitude and phase information from previously processed sensor signals occurring when previous detectors 150 were triggered until all the sensors 134 in the array 148 have been processed for each detector 150.

Once the sensed signal with respect to the object 132 has been analyzed in the manner discussed herein, it is sorted. The sorting command is sent by the computer 144 via connection 153 in FIG. 1 to a diverting gate 151. If activated, the gate 151 allows the object 132A to fall into a bin 150; if the gate is not activated, the object 132 falls into a bin 152 from a chute 154.

Figure 2:
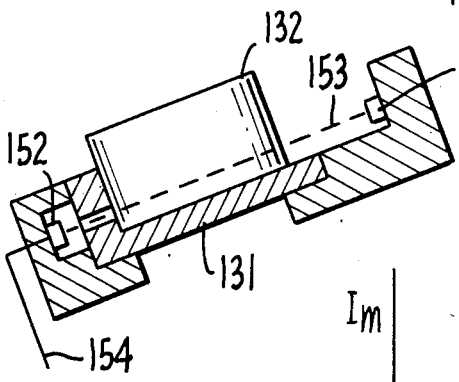
FIG. 2 shows a portion of a feed mechanism for the system in FIG. 1.

The part transport mechanism shown in FIG. 2 is a gravity chute 131 upon which objects 132 can slide, but may also be a variety of other part transport mechanisms used in automation, such as a conveyor belt, an indexing machine, a feeder bowl or a robot manipulator. The position detector in FIG. 2 is a simple infra-red LED beam-trip; when an object 132 interrupts a beam 153 transmitted between an emitter 151 and a detector 152 of the trip, a voltage signal is sent via a connection 154 to the MUX 146 (FIG. 1). For other transport mechanisms, other position detectors are appropriate. For example, on a conveyor belt, a proximity detector is often appropriate, on an indexing machine the index station signal is appropriate and, on a robot manipulator, the encoder signals from its joints are appropriate.

In some applications, the sensors 134 (FIG. 1) themselves are appropriate for position sensing (see also U.S. Pat. No. 4,287,769, the disclosure of which is incorporated herein by reference). In this embodiment, one of several sensors 134 look for a match, or nearly a match, between prior phase and amplitude information on good parts 132 (as discussed below in detail). If a match is made, the computer 144 signals the MUX 137 to that described above for other position detectors.

Once the phase and amplitude measurements made by the sensors 134 have been determined and stored in the computer 144, they are compared to previously-stored phase and amplitude data taken on good parts 132. There may have been several "different" good parts 132 representing different orientations of the same part 132. For example, if the part 132 is a fastener such as a machine screw, it can slide down the chute 131 in two orientations: threads first and heads-first. In other applications, the parts 132 fed down the chute 131 have several different shapes as in a kitting operation where both nuts and screws are to be inspected.

In any case, the comparison involves subtracting the new data from the previous to determine the difference:

$$\Delta g = g/_{previous} - g/_{new},$$

where $g/_{previous}$ is the previously stored and $g/_{new}$ is the new data.

Figure 3:
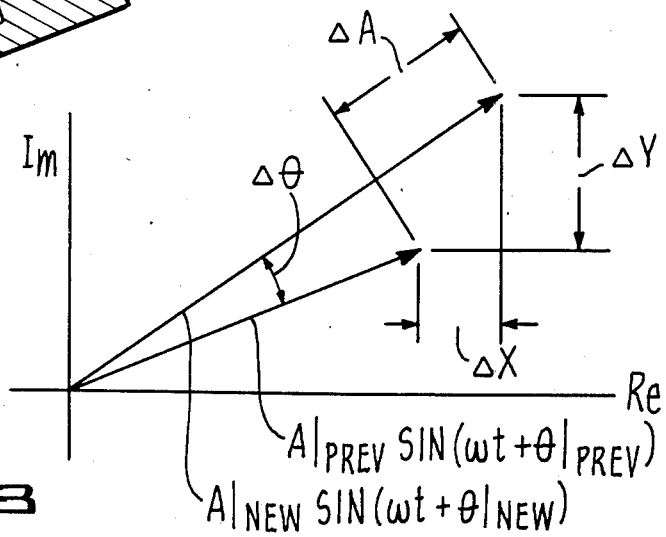
FIG. 3 shows graphically phase and amplitude data with respect to wave energy applied to an object and emitted after interaction with the object for use in connection with determination of a characteristic of the object.

The changes or differences, $\Delta g$, can represent any of four possible phase and amplitude data as shown in FIG. 3. First, the change in amplitude between the two waves may be used; this is shown on the phasor diagram in FIG. 3 as "$\Delta A$". This measure plus the change in phase, $\Delta\phi$, between the two waves may represent $\Delta g$ expressing the changes in polar coordinates. The vector difference may also be expressed in rectangular coordinates using either $\Delta X$ or $\Delta Y$ as shown in FIG. 3.

The quantity $\Delta g$ is a generalized wave difference measure. It represents the following vector quantity of the four components.

$$\Delta g = \begin{bmatrix} \Delta A \\ \Delta\phi \\ \Delta X \\ \Delta Y \end{bmatrix}$$

By using all four of these quantities, the most value can be extracted from an individual transducer 134. However, in practice some of the information is redundant, so only one or two of the four components are usually used.

A single object 132 can trigger a large matrix of data. First, each sensor 134 can generate up to four difference measures, as just described. Second, each system 130 has a multiplicity of detectors 150 which trigger data-taking on each of the sensors 134.

Consider a simplified example. Suppose each sensor 134 measured only one component of the wave difference vector, $\Delta\phi$, that the system had eight such sensors 134 and that eight position detectors 150 were used to determine the position of object 132. Hence, a matrix of sixty-four data values are available to compare with previously stored signatures. An important embodiment of the present invention is to reduce this data so that only relevant information need be compared. Rather than comparing all sixty-four values to each of several orientations of object 132, much of the data is disregarded in order to speed the time taken for the computer 144 to arrive at an accept/reject decision. Let the object be a symmetrical object such as a cylindrical disc sliding down a parts chute 131. Such an object 132 has only one stable orientation. During the learning phase of the system's operation, a parts feeder feeds a good discs one-at-a-time down the parts chute 131. As each of these good discs triggers a position detector 150, phase information is recorded for each sensor 134.

More than one good disc is used in order to build a statistical base of the measurements for each sensor 134. Thus, not only is the average phase measurement for each sensor 134 determined, but also its standard deviation. Again, assuming eight sensors 134 and eight position detectors 150, sixty-four phase measurements are recorded for each disc. After a statistically valid number of the discs have been measured, say one hundred discs, sixty-four average phase measurements and sixty-four standard deviations are calculated for the eight sensors 134 for the eight detectors 150.

Next a "bad" object (or objects) is slid down the chute 131, triggering detectors 150 and causing data to be recorded for the sensors 134. Again, sixty-four values are determined for each "bad" object 132. Here, a "bad" object is a defective one which differs in a known way from the "good" objects whose statistics have already been measured. For example, a "bad" nut might be one with no threads; a "bad" screw might be one where the threads are coarse rather than fine; a "bad" disc might be one whose height is higher than the "good" disc.

For each of the sixty-four data elements, the phase measurements of bad objects will deviate from the mean phases established for good parts by a certain number of standard deviations. FIGS. 1, 4A, 4B and 4C show histograms noted generally at 181, 182, 183 (or scatter diagrams), respectively, representative data elements (each element is defined by a particular sensor 134 triggered by a particular detector 150). Each diagram plots the frequency of occurrence of phase values for the many good objects 132 which were examined.

In the diagram 181, the phase measurements for the good parts have little scatter; the standard deviation ($\sigma_1$) indicates the amount of scatter from the means ($\overline{\Delta\phi}_1$). Also shown is the deviation from the mean ($\overline{\Delta\phi}_1 - \Delta\phi/\text{Bad}$) of a bad object 132. Similarly, the diagrams 182 and 183 illustrate such information for the ith element and for the nth (i.e., 4th) element. Each element differs in standard deviation ($\sigma_1$) due to such factors as the sensitivity of the sensor 150, the manufacturing variations of the object 132, the variation in velocity of the object 132, as well as other noise sources. Also, each element differs in its sensitivity to the bad object 132: some elements are closer to the defect's location and some elements may be insensitive regions of the acoustic or electromagnetic field around the object 132.

In the present invention of the multiplicity of elements is rank-ordered to find those elements which are least sensitive to measurement noise, and at the same time are most sensitive to the particular defect. The rank ordering is based on the normalized phase error—the phase, difference between the mean phase of good parts and the phase of a bad part, divided by the standard deviation of the good parts:

$$Z_i = \frac{\overline{\Delta\phi_i} - \Delta\phi_i/\text{Bad}}{\sigma_i}$$

This measurement emphasizes the desired differences in parts, yet is insensitive to the normal variations in the objects or measurements. By choosing those elements with the highest normalized phase differences ($Z_i$), the system is optimized to be most sensitive to the desired defect.

Thus, instead of processing all sixty-four data elements, only a small number, perhaps eight, of these elements are chosen by the computer for processing as described earlier. Not only is it quicker to process the information from eight elements than from sixty-four, but those elements eliminated are those which add little to detecting the desired differences in objects 132.

Figure 4A:
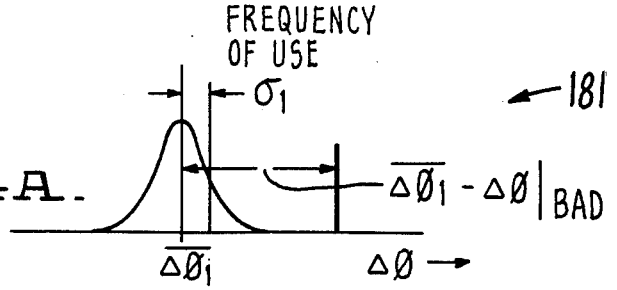
FIGS. 4A, 4B and 4C are histograms (or scatter diagrams) for three data elements in a functioning system of the type shown in FIG. 1.
Figure 4B:
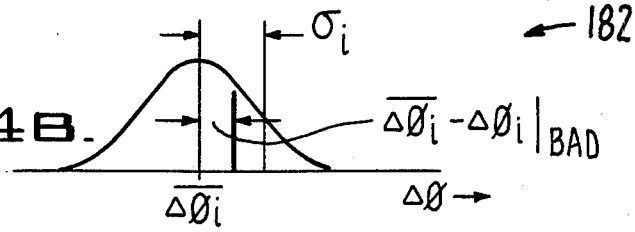
Figure 4C:
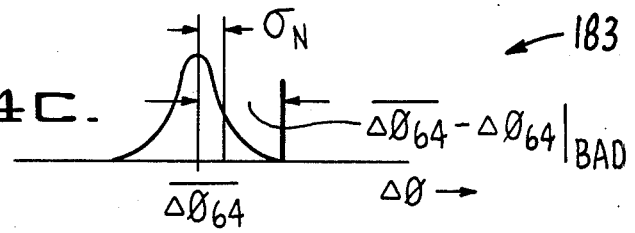

To illustrate this method of rank ordering, consider the diagrams in FIGS. 4A–4C. In the diagram 181, the "good—bad" phase difference is much greater than the standard deviation of good parts for element 1 (i.e., the element associated with the first sensor 134 and the first detector 150). In the diagram 183, the good-bad" phase difference divided by the standard deviation for good parts of the same element is much less than in the diagram 181. Thus, the element 1 would be ranked before element 64. The diagram 182 illustrates the (Z score) of another sensor: it has a low "Z score" since the "good-bad" phase difference is less than the standard deviation of good parts. It would be ranked below either of the previous two elements.

Of course for the situation where another variable besides phase is being used, the general case is given by:

$$Z_i = \frac{\overline{\Delta g_i} - \Delta g_i/\text{Bad}}{\sigma_i},$$

where $Z_i$ is the statistical difference for a particular sensor information at a particular location;

$\Delta g_i$; is the mean of said sensor amplitude and phase information for correct parts;

$\Delta g_i$/Bad is the same information taken for incorrect parts, and $\sigma_i$ is the standard deviation of the information for correct parts.

The procedure of rank-ordering the Z-scores is done only once for each orientation of the object 132 during a "learn" phase prior to the actual sorting of parts. Once good and bad parts are learned and Z scores determined, sorting of unknown objects 132 begins. Unknown objects 132 are fed past the sensors 134 in FIG. 1 and wave information is accumulated as the object is detected by each position detector 150—much as was done during the "learn" phase.

Mow, however, only the information from certain elements (i.e., detector 150—sensor 134 combinations) need to considered: those which were previously found to have high Z scores. This information is processed to provide an accept/reject signal which is very sensitive to the defects learned, information from other elements is simply disregarded. In the sorting phase the accept-/reject signal is used to divert the object 132 to its proper destination.

Figure 5A:
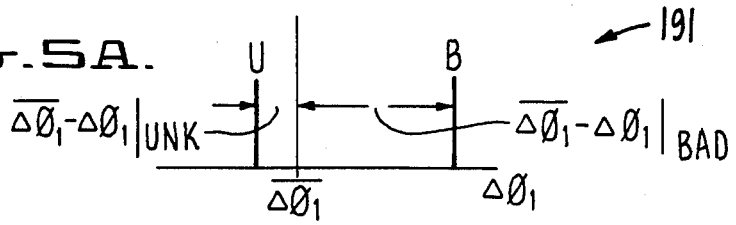
FIGS. 5A, 5B and 5C are diagrams showing phase differences between objects scanned by the system of FIG. 1.
Figure 5B:
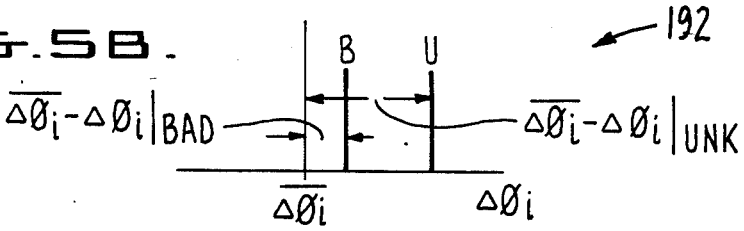
Figure 5C:
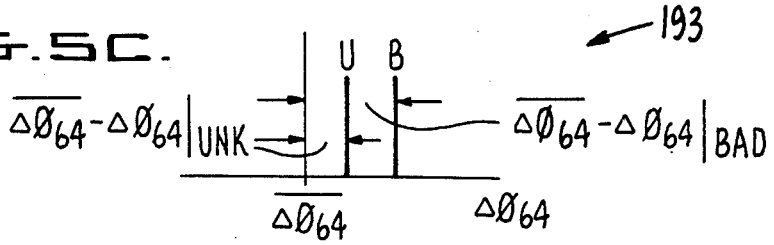

In another embodiment of the present invention, still further information can be gleaned in recognizing the difference between a good part 132 and bad one during sorting. Shown in FIGS. 5A, 5B and 5C are the phase-difference values for an unknown marked "U". In the diagram noted generally at 191, the unknown difference is on the opposite side of the mean than the phase difference associated with the bad object. However, in the diagrams noted generally at 192 and 193, the unknown phase difference marked "U" is on the same side of the respective mean as the bad part. Thus, another method of determining the validity of a particular element's information is to check its sign compared with that of a previously-determined "bad" object (i.e., the sign of the wave information as expressed by the computer's registers). A measure of the unknown object's "badness" is determined. If an unknown object has half of the phase measurements, $\Delta\phi i$, from its various elements having the same sign as a bad object and half having opposite sign, the unknown object is likely a good object. On the other hand, if the measurements are predominantly the same sign as bad objects, the unknown object is more likely bad.

In yet another embodiment, both the elements with high Z scores as well as those having the same sign as the bad object are selected for comparison. In this method, only those $\Delta\phi i$ identified in the learn phase as having high Z scores are initially chosen for comparison. Of these, only those having the same sign as the previously learned bad objects are further compared. Combining the methods of high Z scores and "like signs" sensitizes the measurements to the bad objects more than either single method could in isolation.

Further modifications of the invention herein disclosed will occur to persons skilled in the art and all such modifications are deemed to be within the scope of the invention as defined by the appended claims.

What is claimed is:

1. Apparatus for parts sorting, that comprises:

parts transport means to transport a part into an interaction region;

means for transmitting continuous wave energy of a single frequency into said interaction region where the wave energy interacts with said part;

detector means comprising a multiplicity of spaced-apart detectors for detecting the location of said part at a multiplicity of locations within said interaction region and adapted to provide a feedback signal indicative of each said location;

sensor means comprising a multiplicity of spaced-apart sensors disposed to receive said wave energy at a multiplicity of places after interaction with the part and to provide electrical signals representative of at least one of amplitude and phase information of the received wave energy for each sensor of said sensor means for each location on the basis of said feedback signal;

means for analyzing said at least one of amplitude and phase information from the multiplicity of sensors into at least one of a geometric and an electromagnetic characteristic of said part for each said location; and means for sorting said part in response to said characteristic.

2. Apparatus as in claim 1 wherein said characteristic is the orientation of said part.

3. Apparatus as in claim 1 wherein said means for analyzing includes considering the statistical measurement of correct parts and incorrect parts such that said characteristic is sensitive to the statistical differences between the measurements of a correct part relative to an incorrect part and insensitive to the statistical variations of the correct parts.

4. Apparatus as in claim 1 wherein a subset of information from each location of said multiplicity of locations is chosen and wherein each said subset is chosen based upon maximizing the statistical differences between correct and incorrect parts.

5. Apparatus as in claim 4 wherein said statistical differences are given by:

$$Z_i = \frac{\overline{\Delta g_i} - \Delta g_i/\text{Bad}}{\sigma_i},$$

where $Z_i$ is the statistical difference for a particular sensor information at a particular location;

$\overline{\Delta g_i}$ is the mean of said sensor information for correct parts, $\overline{\Delta g_{i/Bad}}$ is the same information taken for incorrect parts, and $\sigma_i$ is the standard deviation of the information for correct parts.

6. A method of determining a characteristic of an object, that comprises:

transporting the object into and through an interaction region;

transmitting continuous wave energy of a very narrow band of frequencies into the interaction region where the wave energy interacts with the object, is affected by the interaction with the object and, after the interaction, emits from the interaction region;

detecting at spaced locations distributed along the path of travel within the interaction region the positions of the object as it moves into and through the interaction region to provide feedback signals indicating the particular position of the object within the interaction region as it passes therethrough;

sensing the wave energy that emits from the interaction region at a multiplicity of spaced places to provide electric signals representative of said characteristic for each said particular position;

processing the electric signals for each said particular position to derive therefrom information regarding said characteristic for each place of the multiplicity of spaced places;

analyzing the information for each place of the multiplicity of places with respect to each said particular position to derive data representing the characteristic of the object at each said position; and sorting the object on the basis of said data.

7. A method according to claim 6 in which the wave energy is sinusoidal acoustic wave energy of a single frequency in the ultrasonic frequency range and said characteristic is a geometric characteristic of the object.

8. A method according to claim 7 in which the ultrasonic frequency is between about 20 kHz and 200 kHz and in which the geometric characteristic is the shape of the object.

9. A method according to claim 6 in which the wave energy is low frequency electromagnetic wave energy of a single frequency between about 100 kHz and about 200 kHz and the characteristic is an electromagnetic characteristic.

10. A method according to claim 6 which includes measurement of said characteristic with regard to objects which meet established standards and objects which do not meet the established standards such that said data is sensitive to statistical differences between the measurements of objects which meet the established standards relative to those objects which do not meet the established standards and insensitive to statistical variations of objects which meet the established standards.

11. Apparatus for object sorting and the like that comprises: means to transport the object into and through an interaction region of the apparatus; means for transmitting wave energy at a narrow band of frequencies into the interaction region where the wave energy interacts with the object; sensory means that includes a plurality of sensors positioned to receive wave energy emanating from the object and operable to provide signals representative of at least one of amplitude and phase information with respect to the received wave energy from a plurality of spaced object locations within the interaction region; means for analyzing the at least one of amplitude and phase information from the plurality of sensors into a characteristic of the object for each location of said plurality of spaced locations; and means to sort the object in response to the characteristic.

12. A method of object sorting on the basis of a characteristic of the object that comprises: transporting the object along a path into and through an interaction region; detecting the position of the object at a plurality of spaced locations as it moves through the interaction region; providing feedback signals indicative of each location of the plurality of locations of the object in the interaction region; connecting the feedback signal as one input to a computer; transmitting continuous wave energy of a very narrow band of frequencies into the interaction region where the wave energy interacts with the object, is affected by the interaction with the object and, after the interaction, emanates from the interaction region; sensing the wave energy that emanates from said each location of the interaction region at a multiplicity of spaced places; providing an electric signal representative of the sensed wave energy from said each location at each place of the multiplicity of spaced places, which electric signal contains information with respect to the characteristic of the object at said each location; connecting the electric signal as a second input to the computer; the computer serving to process the electric signal received from said each place of the multiplicity of spaced places for said each location to derive therefrom information with respect to the characteristic of the object at said each location, which information is stored by the computer until each electric signal with respect to said each location of the object in the interaction region has been processed, the stored information being then compared by the computer with similar information, previously stored in the computer; and sorting the object on the basis of the comparison.

13. A method according to claim 12 that includes a learning phase wherein a plurality of objects is moved along the path to provide, for the computer, a matrix of data with respect to said characteristic to build a statistical basis for evaluation of each said electric signal.

14. A method according to claim 13 wherein the computer evaluates the matrix of data in terms of phase of the electric signal and in which the evaluation is based in part on average phase values and standard deviation.

15. A method according to claim 14 in which the evaluation in terms of standard deviation is based on information for histograms, each histogram being based on a data element, wherein a data element represents data for the electric signal with respect to said each place with respect to said each location.

16. A method according to claim 15 in which each said data element is rank ordered.

17. Apparatus for deriving information with respect to a characteristic of an object, that comprises: means to transport the object along a path into and through an interaction region of the apparatus; means to detect the location of the object at spaced locations along said path and to provide a feedback signal noting each location; means for transmitting wave energy at a narrow band of frequencies into the interaction region where the wave energy interacts with the object; sensory means that includes a plurality of sensors positioned to receive wave energy emanating from the object and operable to provide electrical signals representative of at least one of amplitude and phase information with respect to the received wave energy from each spaced location in the interaction region; means for analyzing that is connected to receive the feedback signal and the electrical signals and that is operable to convert the at least one of amplitude and phase information from the sensors into a characteristic of the object with respect to each said location.

* * * * *